US009437982B2

(12) United States Patent
Wu et al.

(10) Patent No.: US 9,437,982 B2
(45) Date of Patent: Sep. 6, 2016

(54) CABLE CONNECTOR ASSEMBLY

(71) Applicant: HON HAI PRECISION INDUSTRY CO., LTD., New Taipei (TW)

(72) Inventors: Jerry Wu, Irvine, CA (US); Jun Chen, Kunshan (CN); Fan-Bo Meng, Kunshan (CN)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/458,178

(22) Filed: Aug. 12, 2014

(65) Prior Publication Data

US 2015/0044911 A1 Feb. 12, 2015

(30) Foreign Application Priority Data

Aug. 12, 2013 (CN) ..... 2013 1 0347650

(51) Int. Cl.
*H01R 13/66* (2006.01)
*H01R 43/20* (2006.01)

(52) U.S. Cl.
CPC ..... *H01R 13/665* (2013.01); *H01R 43/20* (2013.01); *Y10T 29/49174* (2015.01)

(58) Field of Classification Search
CPC H01R 13/665; H01R 43/20; H01R 13/6658; H01R 13/6466; H01R 13/6467
USPC ..... 439/620.22, 620, 620.06, 620.15, 439/620.21, 620.241, 620.2
See application file for complete search history.

(56) References Cited

U.S. PATENT DOCUMENTS 5,955,703 A * 9/1999 Daly ..... H01R 13/6658 174/117 R
6,132,260 A 10/2000 Wu
6,663,415 B1 * 12/2003 Wu ..... H01R 13/5808 439/460
7,429,188 B2 * 9/2008 Wu ..... H01R 13/7172 439/490
7,462,071 B1 * 12/2008 Wu ..... H01R 9/032 439/497
7,607,948 B1 * 10/2009 Lee ..... H01R 9/032 439/620.22
7,625,236 B1 12/2009 Wu
7,651,379 B1 1/2010 Wu
7,758,374 B2 7/2010 Yu et al.
2004/0115988 A1 * 6/2004 Wu ..... H01R 12/62 439/497
2011/0249948 A1 * 10/2011 Wu ..... G02B 6/3817 385/89

FOREIGN PATENT DOCUMENTS

CN 102055087 A 5/2011
CN 102480078 5/2012

* cited by examiner

*Primary Examiner* — Abdullah Riyami
*Assistant Examiner* — Harshad Patel
(74) *Attorney, Agent, or Firm* — Ming Chieh Chang; Wei Te Chung

(57) ABSTRACT

A cable connector assembly includes a connector comprising an insulative body, a number of conductive terminals received in the insulative body, and a printed circuit board (PCB) electrically connected with the conductive terminals; a cable having a plurality of core wires; and a number of electronic components disposed on the PCB. The insulative body includes a front face and a rear face opposite to the front face. The PCB has a front portion electrically connected with the conductive terminals, a rear portion electrically connected with the core wires, and a middle portion connecting the front portion and the rear portion. The rear portion has a number of first pads electrically connected with the core wires. The front portion and the middle portion are disposed in the insulative body and the rear portion is disposed outside of the insulative body.

10 Claims, 6 Drawing Sheets

CABLE CONNECTOR ASSEMBLY

BACKGROUND OF THE INVENTION

1. Field of the Invention

The present invention relates to a cable connector assembly and an assemble method of the same, and more particularly to a cable connector assembly having an insulative body mated with a printed circuit board.

2. Description of Related Arts

U.S. Pat. No. 6,132,260, issued on Oct. 17, 2000, discloses a cable connector assembly comprising a main housing, a mating member, a plurality of mating contacts and a middle circuit board. Each mating contact comprises a soldering section for engaging with the middle circuit board. The whole mating contacts and the middle circuit board are received in the main housing.

U.S. Pat. No. 7,758,374, issued on Jul. 20, 2010, discloses a cable connector assembly comprising a connector and a cable with a plurality of core wires. The connector comprises an insulative body, a plurality of conductive terminals received in the insulative body, and a printed circuit board electrically connected with the conductive terminals.

U.S. Pat. No. 7,651,379, issued on Jan. 26, 2010, discloses a cable assembly comprising an insulated housing, a contact module, a cable, and a printed circuit board. A plurality of conductive pads are formed on the printed circuit board. The conductive pad extends from a front portion to a rear portion of the printed circuit board, comprising a front end connected with the contact of the contact module, a rear end connected with the cable, and a connecting portion connected between the front portion and the rear portion. The front portion of the printed circuit board is disposed between the contacts extending out of the insulator of the contact module. The rear end of the printed circuit board is exposed out of the insulated housing.

An improved cable connector assembly is desired to offer advantages over the related art.

SUMMARY OF THE INVENTION

An object of the present invention is to provide a cable connector assembly having a printed circuit board mated with an insulative body.

To achieve the above-mentioned object, a cable connector assembly a connector comprises: an insulative body, a plurality of conductive terminals received in the insulative body, and a printed circuit board (PCB) electrically connected with the conductive terminals; a cable having a plurality of core wires; the insulative body comprising a front face and a rear face opposite to the front face, the PCB comprising a front portion electrically connected with the conductive terminals, a rear portion electrically connected with the core wires, and a middle portion connecting the front portion and the rear portion, the rear portion comprising a plurality of first pads electrically connected with the core wires, the front portion and the middle portion being disposed in the insulative body, the rear portion being disposed outside of the insulative body; and a plurality of electronic components disposed on the middle portion.

According to the present invention, the printed circuit board is received in the insulative body in a greatest degree to minimize the length of the cable connector assembly. The design ensures the miniaturization and high performance of the product and saves the space.

DETAILED DESCRIPTION OF THE PREFERRED EMBODIMENT

Reference will now be made in detail to a preferred embodiment of the present invention.

Figure 1:
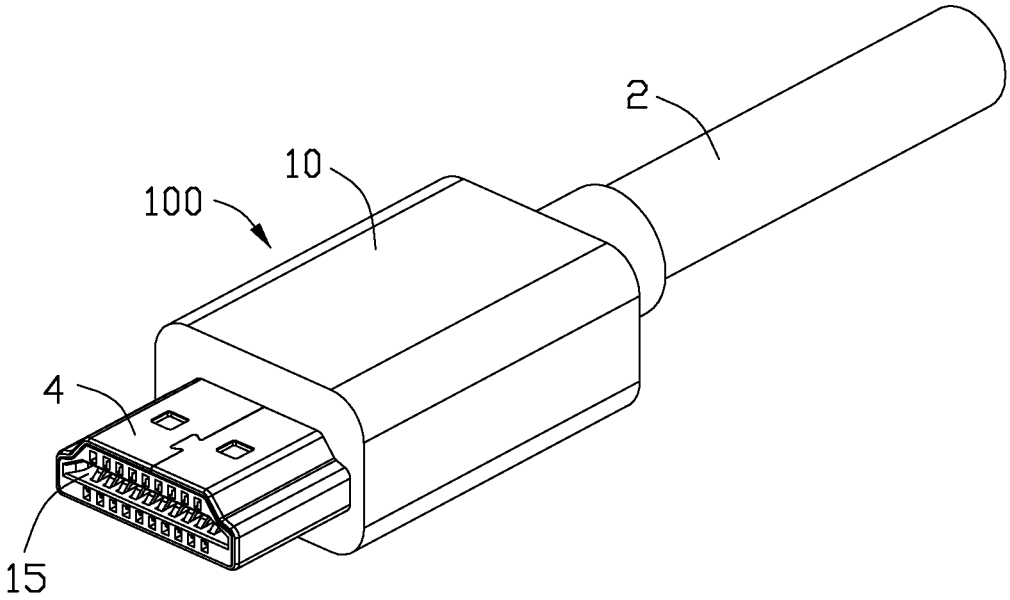
FIG. 1 is a perspective view of a cable connector assembly in accordance with the present invention.
Figure 2:
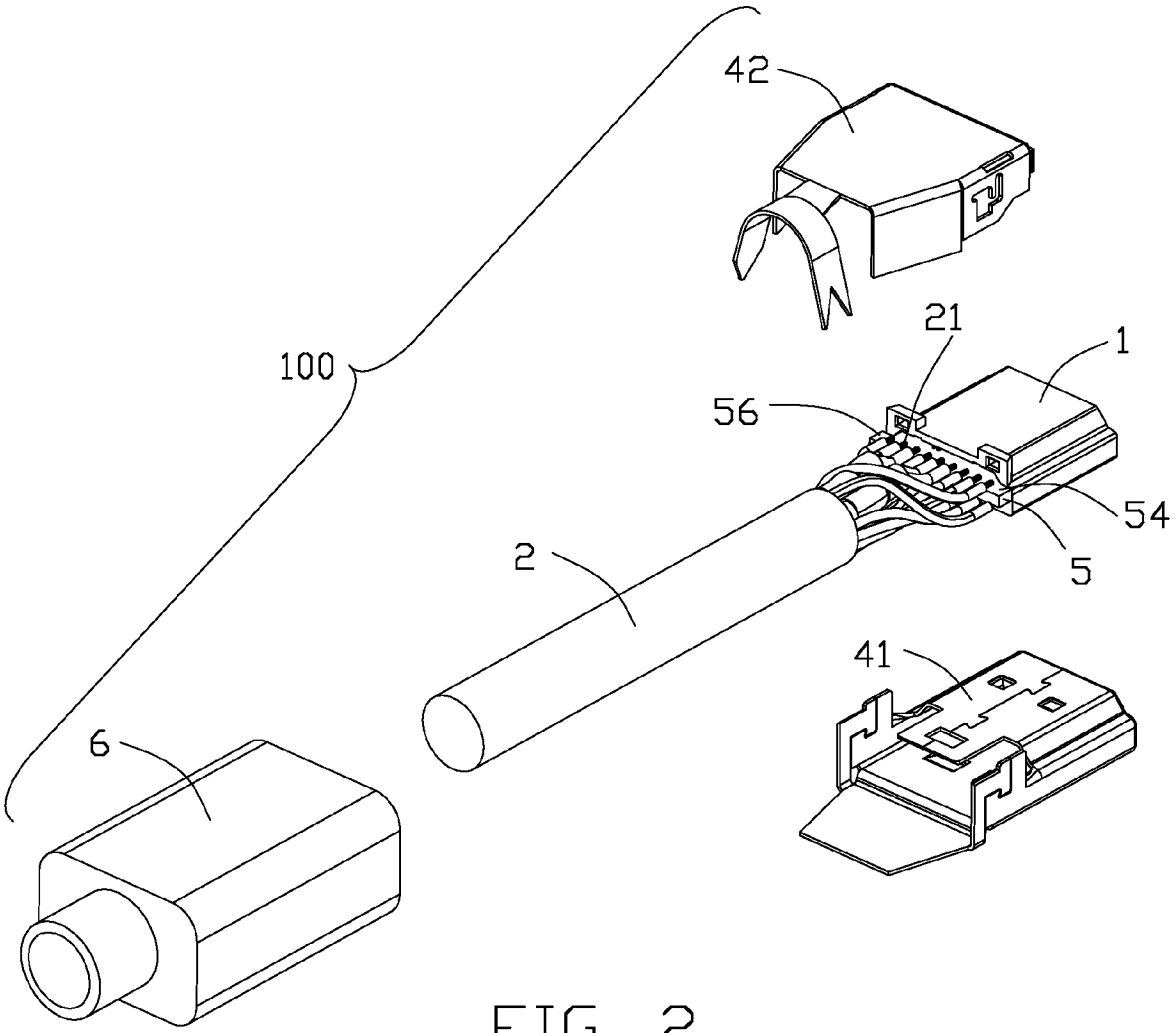
FIG. 2 is a partly exploded view of the cable connector assembly as shown in FIG. 1.
Figure 3:
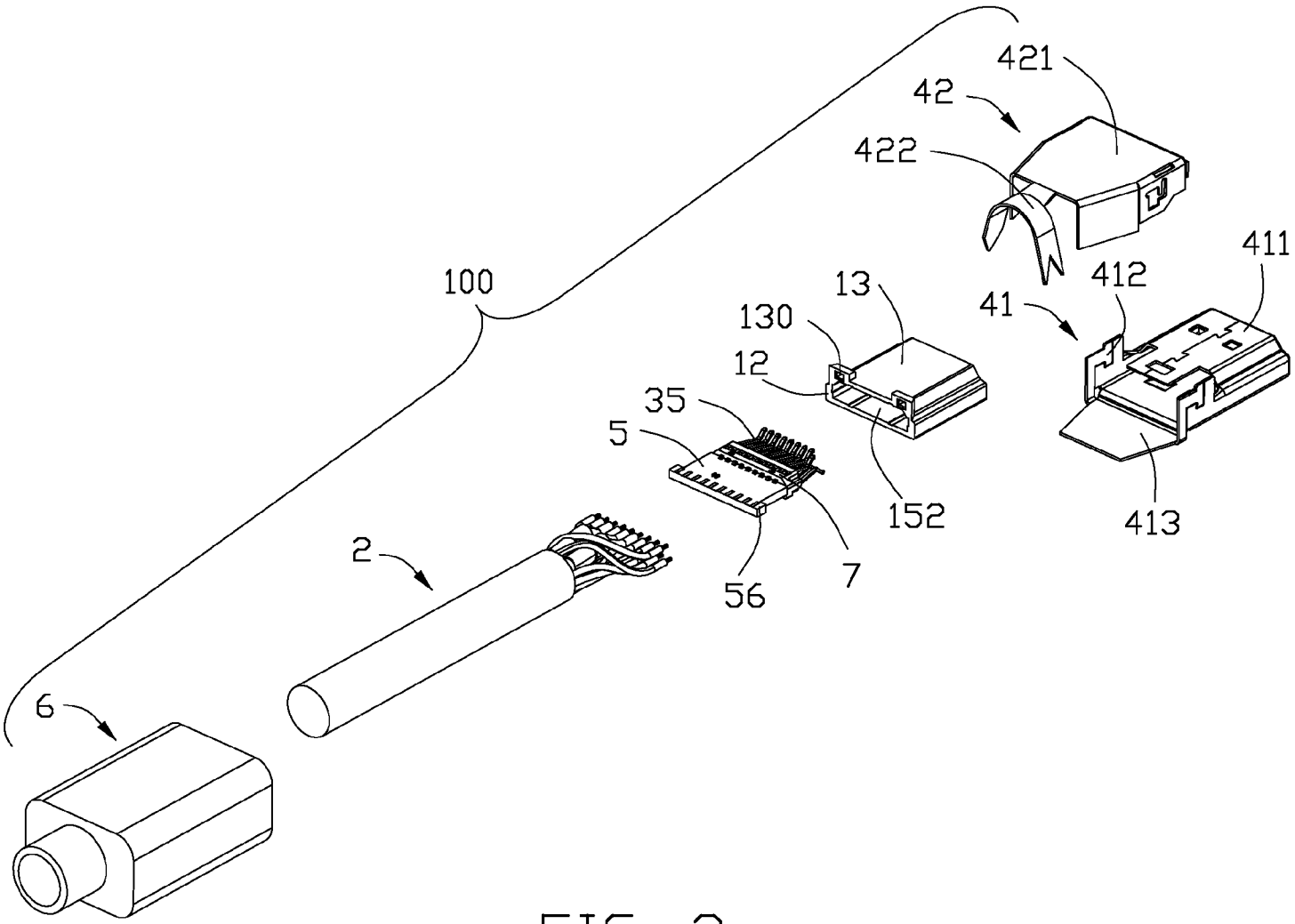
FIG. 3 is another partly exploded view of the cable connector assembly as shown in FIG. 1.
Figure 4:
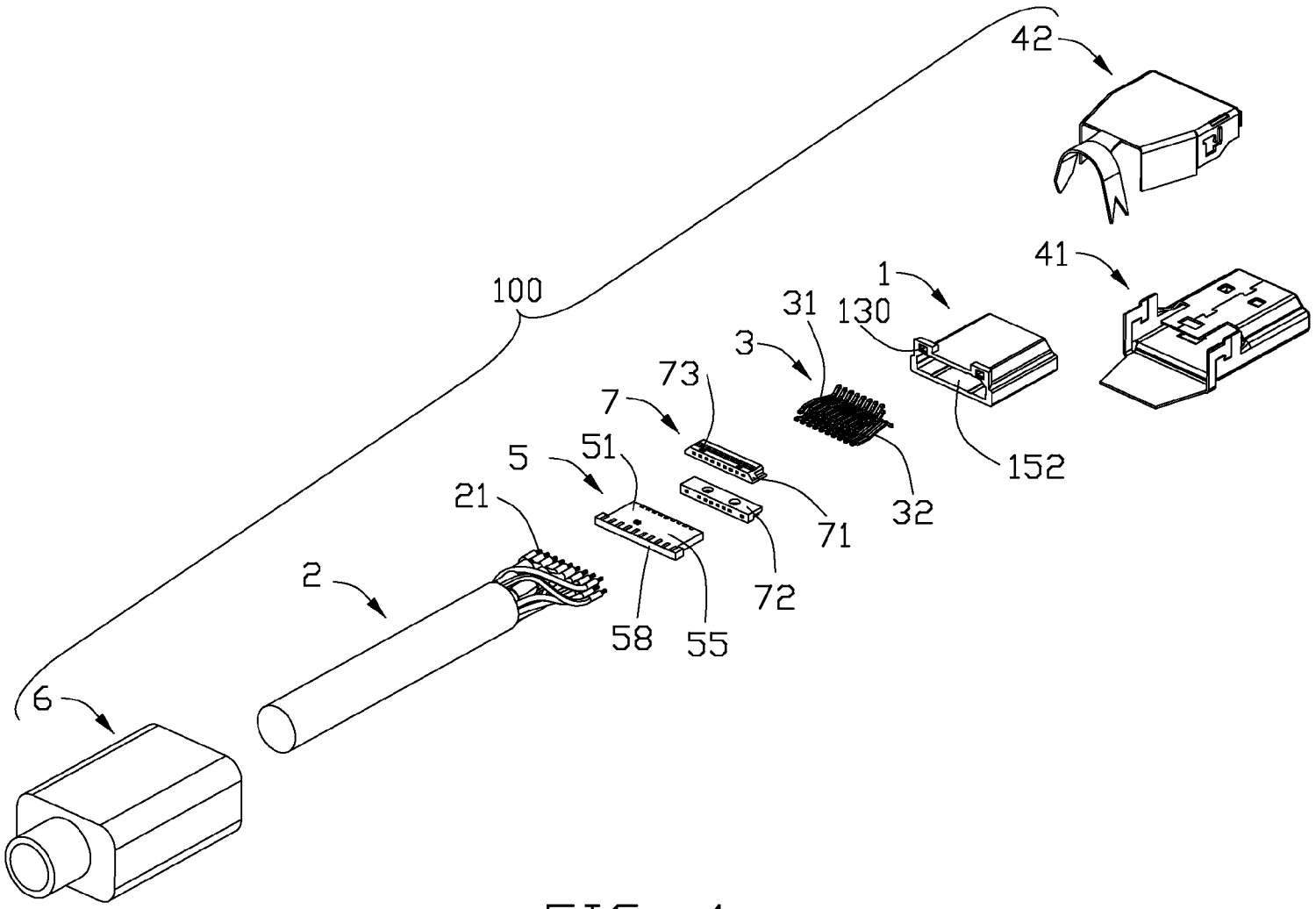
FIG. 4 is an exploded view of the cable connector assembly as shown in FIG. 1.
Figure 5:
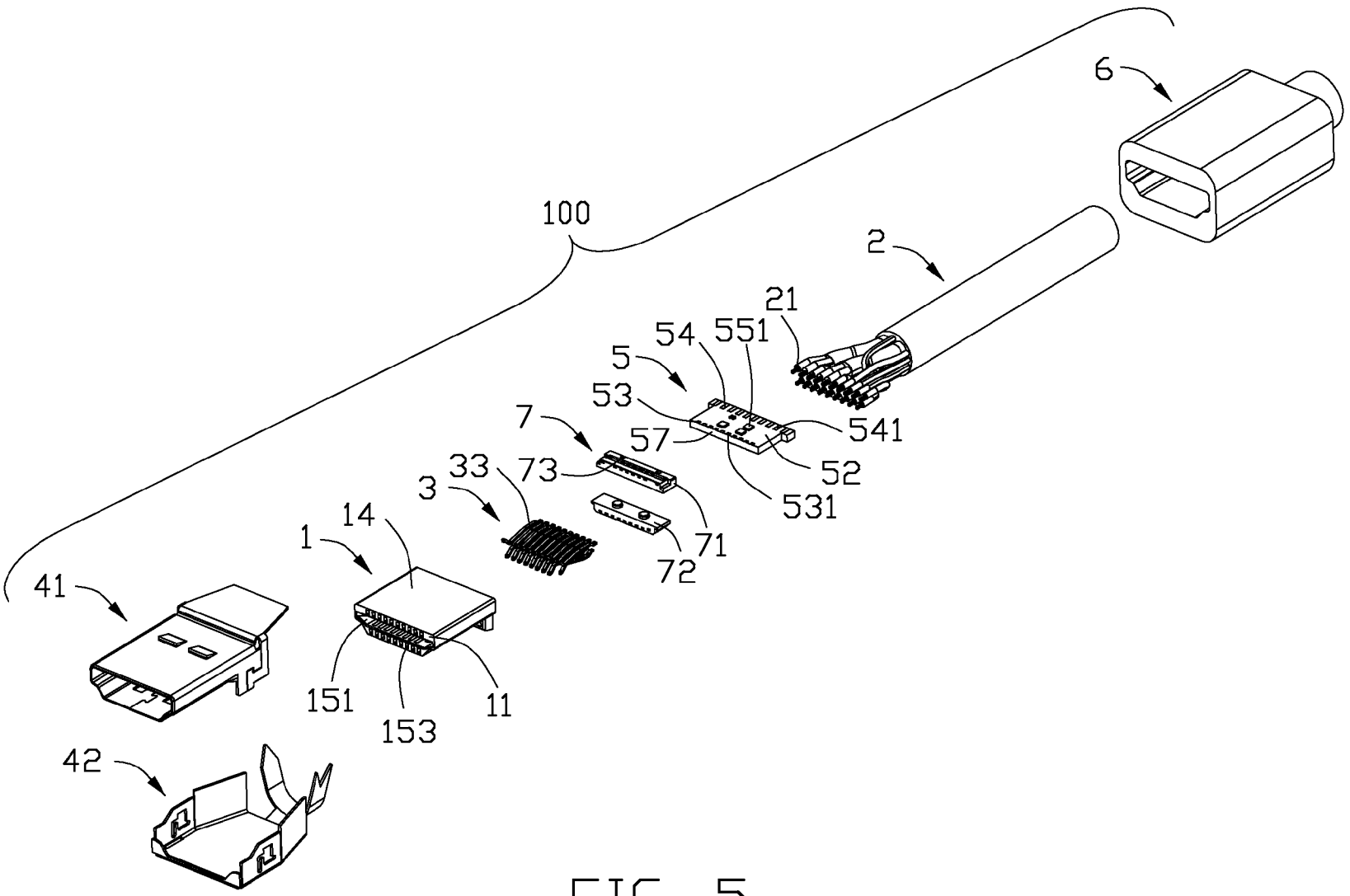
FIG. 5 is another exploded view of the cable connector assembly as shown in FIG. 1.
Figure 6:
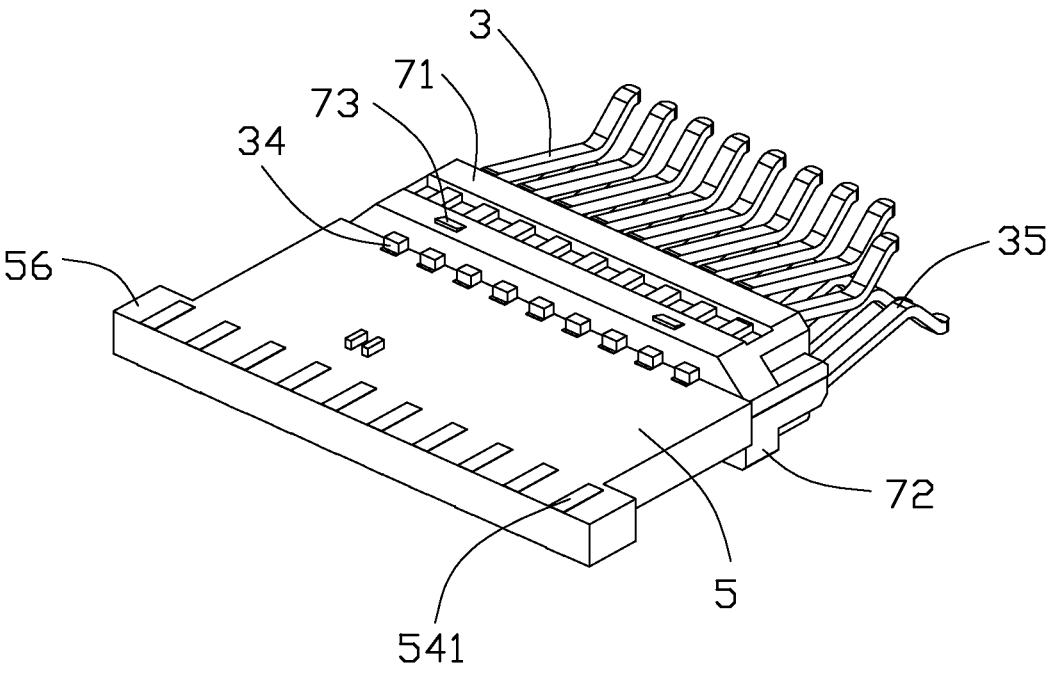
FIG. 6 is a perspective view of the printed circuit board, the conductive terminals and the spacer of the cable connector assembly.

Referring to FIGS. 1 to 6, a cable connector assembly 100 comprises a connector 10 and a cable 2 with a plurality of core wires 21. The connector 10 is an HDMI (High Definition Multimedia Interface) connector. The connector 10 comprises an insulative body 1, a plurality of conductive terminals 3 received in the insulative body 1, a metal housing 4 receiving the insulative body 1, a printed circuit board 5 electrically connected with the conductive terminals 3, and an insulative housing 6 enclosing a rear end of the metal housing 4 and a front end of the cable 2.

The insulative body 1 comprises a front face 11, a rear face 12, a top wall 13, a bottom wall 14, and a receiving space 15 extending through the front face 11 and formed between the top wall 13 and the bottom wall 14. The receiving space 15 comprises an inserting or mating space 151 on the front of the insulative body 1 for receiving an inserting member, and a mounting or connecting space 152 on the rear of the insulative body 1 for receiving the printed circuit board 5. A plurality of terminal slots 153 are disposed on an inner surface of the top wall 13 and the bottom wall 14 of the insulative body 1, respectively. The inserting space 151, the mounting space 152, and the terminal slots 153 are communicated to one another. An end of the top wall 13 of the insulative body 1 comprises a pair of lugs 130. The lugs 130 are disposed symmetrically.

The printed circuit board 5 comprises a first surface 51 and a second surface 52 opposite to the first surface 51, a front wall 57 and a rear wall 58 opposite to the front wall 57, a front portion 53 electrically connected with the conductive terminals 3, a rear portion 54 electrically connected with the core wires 21, and a middle portion 55 connecting the front portion 53 and the rear portion 54. A plurality of second pads 531 are disposed on the front portion 53 of the printed circuit board 5 for electrically connected with the conductive terminals 3 and a plurality of first pads 541 are disposed on the rear portion 54 for electrically connected with the core wires 21. Both of the first and the second surfaces 51,52 have the first and the second pads 541,531. A width of the first pad 541 is lager than the width of the second pad 531. Each first pad 541 is soldered with the corresponding core wire 21. A pitch between the adjacent second pads 541 is equal to the pitch between the adjacent conductive terminals 3 embedded in the insulative body 1. The pitch between the adjacent first pads 541 is lager than the pitch between the adjacent second pads 531. A plurality of electronic components 551 or electric circuits or chips received in the insulative body 1 are disposed on the middle portion 55. The electronic components 551 or electric circuits or chips could provide the function such as adjusting the impedance and the decoding to expand the function of the connector. A pair of flanges 56 extend outwardly from the two side of the rear portion 54 of the printed circuit board 5. The flanges 56 go against the rear face 12 of the insulative body 1 to prevent the printed circuit board 5 from moving into the mounting space 152 of the insulative body 1. The flanges 56 extend along a horizontal direction.

In this embodiment, the printed circuit board 5 is partly received in the insulative body 1. Both the front portion 52 and the middle portion 55 are received in the insulative body 1. The rear portion 54 of the printed circuit board 5 extends out of the insulative body 1 and exposes outside. The front end of the rear portion 54 is flush with the second surface 12 of the insulative body 1. In this way, the printed circuit board 5 can be received in the insulative body 1 in a greatest degree. Only the portion soldered with core wires 21 is exposed outside to reduce the length of the whole cable connector assembly 100. The solution solves the limited space when the cable connector assembly 100 mating with the terminal production. The electronic components 551 or electric circuits or chips received in the insulative body 1 can avoid the collision in production process and improve the function of the product, and also can save the cost.

The cable connector assembly 100 further comprises a spacer 7 connected with the conductive terminals 3. The spacer 7 attaches to the front wall 57 of the printed circuit board 5. In this embodiment, the spacer 7 is molded integrated with the conductive terminals 3. And in the other embodiment, the conductive terminals 3 can be assembled with the spacer 7. The conductive terminals 3 comprise upper conductive terminals 31 and lower conductive terminals 32 arranged in a vertical direction. Each conductive terminal 3 comprises a holding portion 33 held by the spacer 7, a soldering portion 34 extending rearwardly out of the spacer 7 from the holding portion 33, and a mating portion 35 extending forwardly and bending from the holding portion 33. The mating portion 35 is inserted in the mounting space 152 from the rear end to the front end, and extends into the inserting space 151 to mating with the inserting member. The conductive terminals 3 are electrically connected with the printed circuit board 5 by soldering. In this embodiment, the conductive terminals 3 are hotbar or laser soldered with the printed circuit board 5. In the other embodiment, the conductive terminals 3 also can be electrically connected with the printed circuit board 5 by other means. A holding space (not shown) is formed between the soldering portions 34 of the upper conductive terminals 31 and lower conductive terminals 32. The front portion 53 of the printed circuit board 5 is partly received in the holding space at least.

The spacer 7 comprises a first spacer 71 connected with the upper conductive terminals 31 and a second spacer 72 connected with the lower conductive terminals 32. The structure of the first spacer 71 is the same as the structure of the second spacer 72. A plurality of projections 73 project upwardly from an upper surface of the first and the second spacer 71,72 respectively. The projections 73 are used for mating with the inner surface of the insulative body 1 to make the printed circuit board 5 fixed in the insulative body 1 more stable and prevent the printed circuit board 5 and the conductive terminals 3 from retreating from the insulative body 1 after assembling.

The metal housing 4 comprises a first shielding portion 41 and a second shielding portion 42 assembled with the first shielding portion 41 in the vertical direction. The first shielding portion 41 comprises an enclosing portion 411, a first cover portion 412 with an U-shape, and an extending piece 413 extending rearwardly from the first cover portion 412. The first cover portion 412 is formed by extending rearwardly from the end of the enclosing portion 411. The second shielding portion 42 comprises a second cover portion 421 with an U-shape and a cable holding part 422 connected with the second cover portion 421.

A method of assembling a cable connector assembly 100 is described below. When assembling the cable connector assembly 10, mold the spacer 7 integrated with the conductive terminals 3 firstly. Solder the conductive terminals 3 which connected with the spacer 7 to the printed circuit board 5. Then insert the printed circuit board 5 into the insulative body 1 along a back-to-front direction. The printed circuit board 5 is partly received in the insulative body 1. The conductive terminals 3 are received in the terminal slots 153. The front portion 53 and the middle portion 55 are received in the mounting space 152 of the insulative body 1. A plurality of electronic components 551 are disposed on the middle portion 55 and received in the insulative body 1 completely. Solder the core wires 21 of the cable 2 to the rear portion 54 of the printed circuit board 5 to form an electrical connection. Assemble the metal housing 4 out of the insulative body 1. At last, mold the insulative housing 6 enclosed the rear end of the metal housing 4 and the front end of the cable 2. In the other embodiment, the printed circuit board 5 also can be soldered with the core wires 21 firstly, and then to be inserted into the insulative body 1.

Compared to existing technology, the conductive terminals 3 of this invention are shorter than the conductive terminals 3 of other HDMI connectors. In this embodiment, the conductive terminals 3 received in the insulative body 1 occupies the length of the insulative body 1 less than ½. It can guarantee the enough space to receive the front portion 53 and the middle portion 55 of the printed circuit board 5. The rear portion 54 soldered with the core wires 21 is exposed out of the insulative body 1. The front end of the rear portion 54 is flush with the second surface 52. The design reduces the length of the insulative housing 6 and further minimizes the whole length of the connector 10 in an axial direction. The design is convenient to customers for using the cable connector assembly 100 and ensures the miniaturization and high performance of the product and saves the space.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly comprising:

a tubular insulative housing defining a front mating space and a rear mounting space commonly extending through the housing in a front-to-back direction;

a plurality of contacts disposed in the housing with corresponding contacting sections around the mating space;

a PCB (printed circuit board) defining a front portion, a middle portion and a rear portion in sequence along the front-to-back direction and configured to be only forwardly assembled into the mounting space via a rear face of the housing, tail sections of said contacts mechanically and electrically connected to said front portion, a plurality of electronic components mounted upon said middle portion, and a plurality of wires with exposed conductors at front ends thereof soldered upon said rear portion; wherein at least the front portion and the middle portion are both commonly protectively received in the mounting space in a condition that the tail sections of the contacts are pre-assembled to the PCB before both said contacts and said PCB are commonly assembled into the housing via said rear face.

2. The cable connector assembly as claimed in claim 1, wherein the rear portion is equipped with a stopper to abut against the housing for preventing excessive insertion of the PCB into the mounting space.

3. The cable connector assembly as claimed in claim 1, wherein said contacts are unified together via an insulative spacer around the corresponding tail sections.

4. The cable connector assembly as claimed in claim 3, wherein said insulative spacer includes means for retaining to the housing.

5. The cable connector assembly as claimed in claim 3, wherein said spacer is asymmetric in a vertical direction perpendicular to said front-to-back direction while is symmetric in a transverse direction perpendicular to both said front-to-back direction and said vertical direction so as to have one only orientation for insertion into the mounting space.

6. The cable connector assembly as claimed in claim 3, wherein the housing defines a plurality of slots around the mating space to receive the corresponding contacts therein, respectively.

7. The cable connector assembly as claimed in claim 1, wherein the rear portion is exposed outside of the rear face for inspecting soldering between pads of the PCB and the corresponding wires, respectively.

8. The cable connector assembly as claimed in claim 1, wherein a dimension of a sum of the front portion and the middle portion is around one half of a length of the housing along said front-to-back direction.

9. A method of making an electrical connector, comprising steps of:

providing an insulative housing with a receiving space along a front-to-back direction;

providing a printed circuit board (PCB) with a front portion, a middle portion and a rear portion in sequence along said front-to-back direction;

pre-assembling a plurality of contacts with front mating sections and rear mounting sections to the front portion of the PCB;

providing a plurality of electronic components mounted upon the middle portion;

inserting the pre-assembled contacts and PCB into the receiving space via a rear face of the housing to have both the front portion and the middle portion protectively received in the receiving space without exposure; and providing a plurality of wires with corresponding conductors mechanically and electrically connected to the rear portion.

10. The method as claimed in claim 9, wherein the step of pre-assembling comprises unifying the contacts together via an insulative spacer around the mounting sections so as to not only facilitate connection between the mounting sections and the front portion but also facilitate insertion of the contacts into the housing.

* * * * *